US006733001B2

(12) United States Patent
Wagner

(10) Patent No.: US 6,733,001 B2
(45) Date of Patent: May 11, 2004

(54) TOOL FOR EXTRACTING NAILS, TACKS OR STAPLES

(76) Inventor: Jefferson Louis Wagner, 354 Lynwood Dr., Charleston, SC (US) 29414

( * ) Notice: Subject to any disclaimer, the term of this patent is extended or adjusted under 35 U.S.C. 154(b) by 168 days.

(21) Appl. No.: 10/035,965

(22) Filed: Nov. 9, 2001

(65) Prior Publication Data

US 2002/0056832 A1 May 16, 2002

Related U.S. Application Data

(60) Provisional application No. 60/248,271, filed on Nov. 14, 2000.

(51) Int. Cl.[7] ..... B66F 15/00
(52) U.S. Cl. ..... 254/22; 81/383
(58) Field of Search ..... 254/22, 23, 132, 254/27, 24, 384; 29/268; 81/381, 383, 15.8

(56) References Cited

U.S. PATENT DOCUMENTS

| | | | | |
|---|---|---|---|---|
| 82,568 | A | | 9/1868 | Tyzick et al. |
| 222,295 | A | | 10/1879 | McKeever |
| 724,523 | A | | 4/1903 | Threlkeld et al. |
| 725,902 | A | | 4/1903 | Welsh |
| 832,387 | A | | 10/1906 | Jensen |
| 943,322 | A | | 12/1909 | Soles |
| 990,926 | A | | 5/1911 | Swainson |
| 1,151,772 | A | * | 8/1915 | Erickson ..... 81/383 |
| 2,870,988 | A | | 1/1959 | Vazquez |
| 4,007,913 | A | | 2/1977 | Aldrich |
| 4,084,457 | A | | 4/1978 | Berg |
| 4,097,021 | A | | 6/1978 | Loboda |
| 4,776,568 | A | | 10/1988 | Perel |
| 4,798,366 | A | | 1/1989 | Pearson et al. |
| 4,815,707 | A | | 3/1989 | Brown |
| 4,856,759 | A | | 8/1989 | Ness |
| 4,997,163 | A | | 3/1991 | Henning |
| 5,749,113 | A | | 5/1998 | Witter |
| 5,799,381 | A | | 9/1998 | Gannon et al. |
| 6,105,935 | A | | 8/2000 | Wagner |

* cited by examiner

*Primary Examiner*—Robert C. Watson
(74) *Attorney, Agent, or Firm*—Harleston Law Firm, LLC; Kathleen M. Harleston

(57) ABSTRACT

A hand tool for extracting an elongated object that is embedded in the surface of a body includes: a) an elongated, movable first handle member; b) a corresponding second handle member pivotally attached to the first handle member, the second handle member including a first jaw member; c) a floating head portion pivotally attached to the first and second handle members, the floating head portion including a second jaw member and an adjacent curved edge; and d) a lever bar connected at one end to the second handle member and at an opposite end to the floating head portion; and wherein the extracting tool generally has an open position for placing the jaw members on opposite sides of the elongated object, and a closed position for grasping and pulling the elongated object; and the second jaw member is engaged against the first jaw member when the tool is in the closed position, and disengaged from the first jaw member when the tool is in the open position.

18 Claims, 7 Drawing Sheets

TOOL FOR EXTRACTING NAILS, TACKS OR STAPLES

CROSS REFERENCE TO RELATED DOCUMENT

This invention was described in U.S. Provisional Patent Application No. 60/248,271, filed in the U.S. Patent & Trademark Office on Nov. 14, 2000; and in Disclosure Document Number 481938, submitted on Oct. 27, 2000.

BACKGROUND OF THE INVENTION

1. Technical Field

The present invention relates generally to hand-operated tools, and more particularly to a tool for extracting an elongated object, especially a nail, tack or staple, that is embedded in the surface of a body, such as a wooden board.

2. Background Information

In construction, more labor means higher cost. A small amount of time saved in pulling each spent nail, tack or staple from various surfaces in a building during a remodeling project can mean significant labor savings when the time savings for all of the craftsmen for the duration of the remodeling project are tallied. In short, a better extraction tool allows talented craftsmen to spend their time on more challenging tasks.

Generally, various tools for helping carpenters and other workers remove spent nails or the like from surfaces are known. Unfortunately, nail heads are often partially or wholly broken off when a molding or other surface is removed during remodeling. There are also many new types of nails and staples being manufactured today. Many of these new types of nails have smooth finishes and are more slender than nails used in previous generations. Pneumatic finishing nails, for example, ordinarily have a very small, thin head. Modem nails and staples also vary widely in length and diameter. They can be difficult to remove without bending or snapping them, or splintering or otherwise damaging the wooden and other surfaces in which they are embedded. Practically speaking, nails, tacks, and staples do not often present themselves in an erect fashion for removal from boards and other surfaces. A significant percentage of nails, tacks, and staples to be removed are smashed against the surface, or otherwise bent and/or broken off.

Unfortunately, it is difficult to consistently pull a variety of nail types, as well as tacks and staples, under varying conditions using currently available tools. Some workers attempt to use conventional pliers or channel locks to pull nails through wooden boards, which often causes portions of the nail to break or shear off. Available tools often work only on nails which present a substantially straight and significant shaft segment for a nail puller tool to grasp. When a carpenter has to straighten nails in order to use a nail pulling tool, time is wasted. When he or she has to carry several tools for nail, tack and staple removal, and pause to select which tool to use to remove each nail, time is wasted. This is particularly inconvenient when the worker is in an awkward position on a ladder or on a roof or in a crawl space, for example. Incorrect nail, tack or staple removal can result in damage to the wooden surface, such as gouges or holes. In addition, worker frustration and the high physical demands of construction-related jobs are decreased somewhat when nails and the like can be more easily removed.

Upholstery tacks are particularly bothersome to remove, particularly for the growing number of laymen who do their own upholstering. The spent upholstery tacks, or staples, are often liberally implanted in various odd directions into the wooden backs, seats, etc. of the furniture to be re-upholstered. Wiring staples are also bothersome to remove. They are installed, often every 16 inches, over electrical wires to hold the wires in place on wall studs. An easy to use tool that can speed the removal of these and other types of tacks and staples can decrease the amount of time that must be spent on the job and reduce the number of small injuries incurred while struggling with stubborn staples, etc.

BRIEF SUMMARY OF THE INVENTION

The present invention is a hand tool for extracting an elongated object that is embedded in the surface of a body, the tool comprising:

a) an elongated, movable first handle member;

b) a corresponding second handle member pivotally attached to the first handle member, the second handle member comprising a first jaw member;

c) a floating head portion pivotally attached to the first and second handle members, the floating head portion comprising a second jaw member and an adjacent curved edge; and d) a lever bar connected at one end to the second handle member and at an opposite end to the floating head portion; and wherein the extracting tool generally has an open position for placing the jaw members on opposite sides of the elongated object, and a closed position for grasping and pulling the elongated object; and wherein the second jaw member is engaged against the first jaw member when the tool is in the closed position, and disengaged from the first jaw member when the tool is in the open position.

The tool of the present invention presents a unique advantage in that it can aid in quick, safe, clean removal of a wide variety of nails, tacks, or staples, regardless of the position the nail, staple, or tack is in at the time. Damage to the surface, such as splintering and gouging, is minimized because nails, staples, and tacks are more easily and smoothly removed by pulling them through. Crown moldings, baseboards, shelves, paneling, and other surfaces can thus be preserved and reused. The present device does not require a great deal of force to use, and preliminary nail straightening is virtually eliminated, so physical demands are less. Many small injuries, particularly punctures and bruises on the thumb and forefinger, are avoided. Worker job frustration is decreased because spent nails, tacks, staples, and the like can be removed without trouble. The versatile tool of the present invention can grasp and remove short or long, slender or thick nails, tacks or staples, with smooth or rough finishes. This tool is capable of pulling intact or broken-off nails or tacks with broken or small or nonexistent nail heads, so long as some portion of the shaft is visible above the surface. The tool is inexpensive to manufacture, easy to use, and effective in removing quantities of spent nails, staples, tacks, or other elongated objects.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
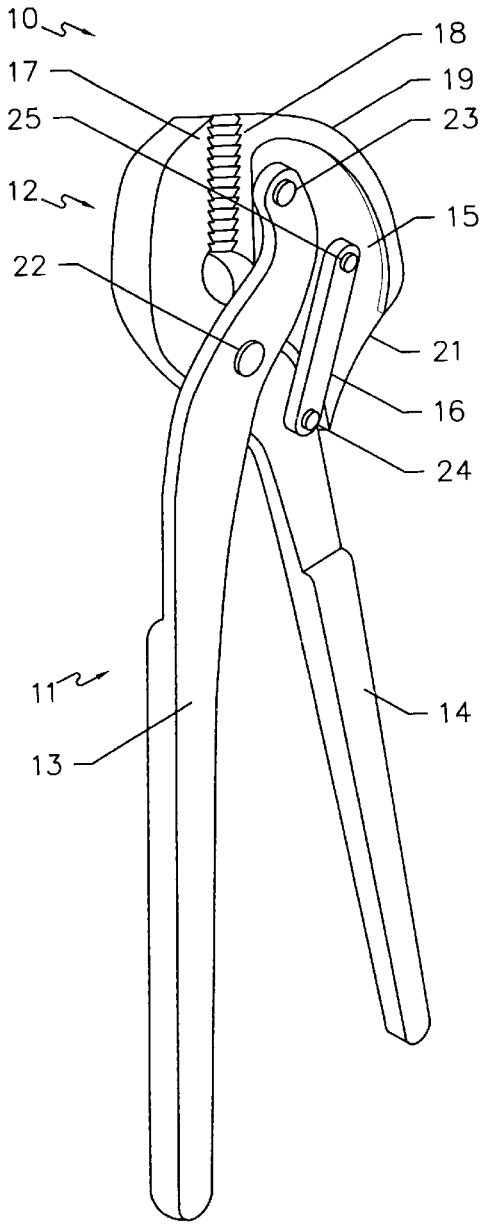
FIG. 1 is a front elevational view of an extracting tool according to the present invention.

In the following description, like reference characters designate like or corresponding parts throughout the several views. Also, in the following description, it is to be understood that such terms as "front," "rear," and the like are words of convenience and are not to be construed as limiting terms. Referring in more detail to the drawings, the invention will now be described.

Figure 2:
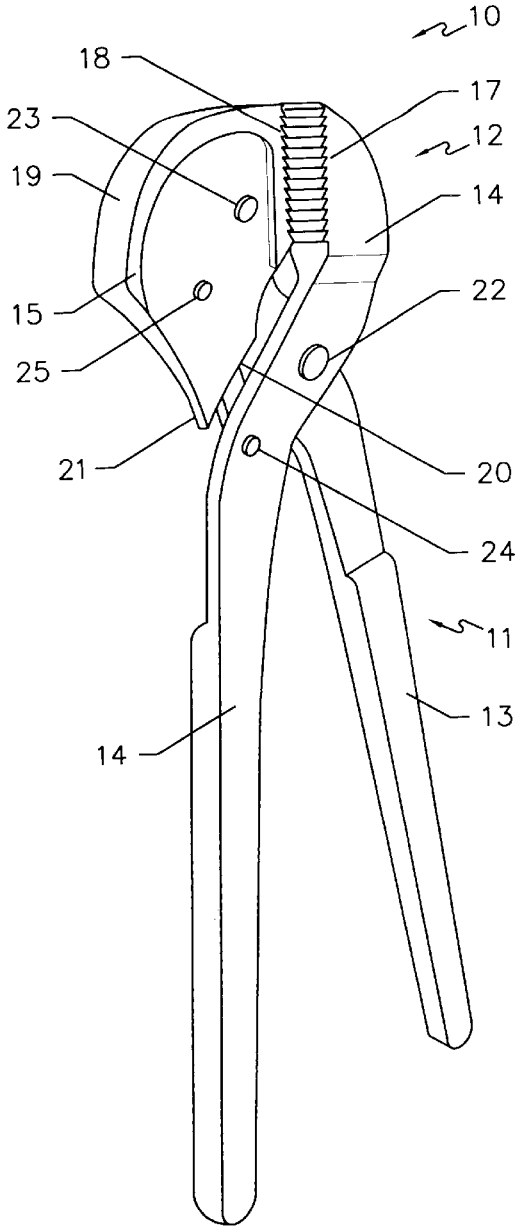
FIG. 2 is a rear elevational view of an extracting tool according to FIG. 1.

Referring to FIGS. 1 and 2, an extracting tool constructed in accordance with the present invention is generally shown at 10. A preferred embodiment of the extraction tool 10 is shown from the front in FIG. 1, and from the rear in FIG. 2. Generally, the extraction tool 10 has an elongated, movable handle section 11 attached to a head portion 12. The head section 12 is at the lower end of the tool when the tool is held by a user in an upright position in readiness for extraction of an elongated object, especially a nail or staple, from a surface in which it is embedded, especially a wooden board. The extracting tool 10 is preferably substantially made of good quality tool steel, or any other suitable, sturdy material.

Figure 3:
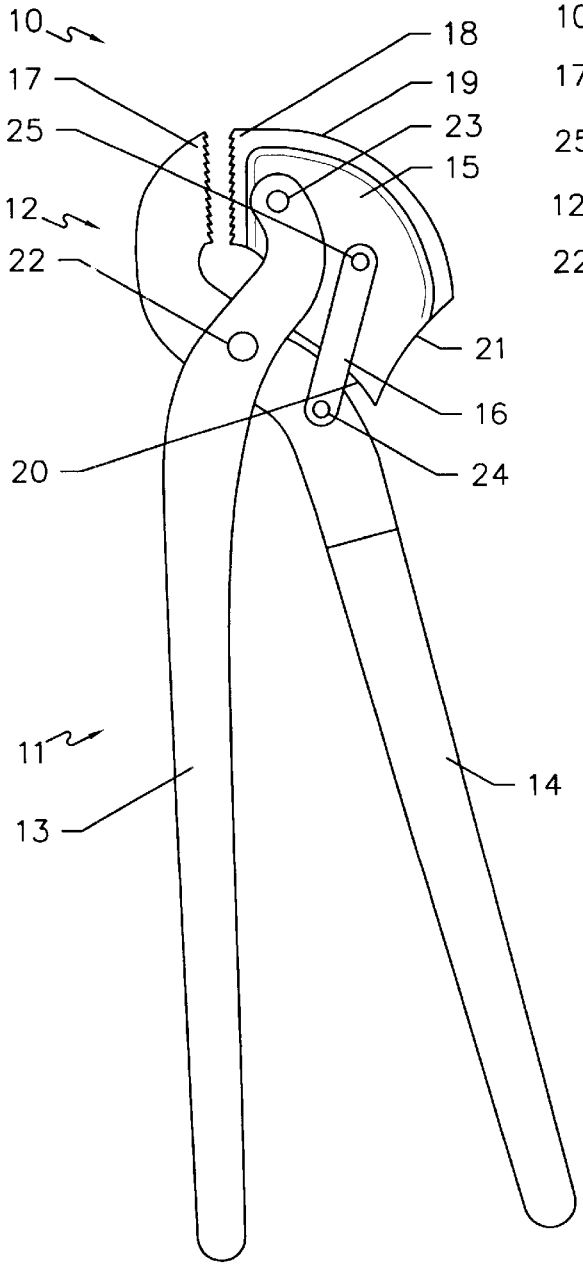
FIG. 3 is a front elevational view of an extracting tool according to the present invention, shown in an open position.
Figure 4:
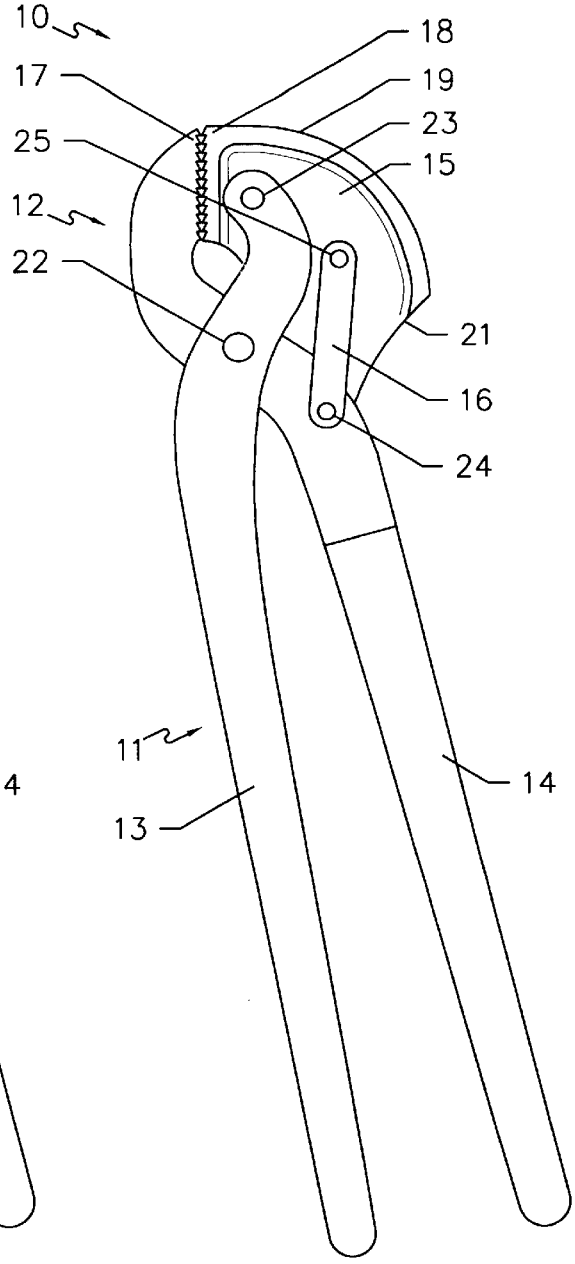
FIG. 4 is a front elevational view of the extracting tool according to FIG. 3, shown in a closed position.

Referring to FIGS. 1–4, the nail extraction tool 10 generally has four parts, with four pivot points: 1) an elongated, movable first handle member 13; 2) an elongated second handle member 14 pivotally attached to the first handle member 13; 3) a floating head portion 15 pivotally attached to the first and second handle members 13, 14; and 4) a lever bar 16, which connects the second handle member 14 and the floating head portion 15. The tool 10 generally has two positions: open, as shown in FIGS. 1 and 4; and closed, as shown in FIGS. 2 and 3.

The removal tool of the present invention is for pulling an elongated object, particularly a nail, tack, or staple (a bent elongated object), which is embedded in the surface of a body. A visible portion of the elongated object, such as the bottom part of a nail shaft (body) or central part of a staple, must extend at least slightly beyond the surface in order for the user to see it and the tool to grasp it. In use, the tool is placed in an open position as shown in FIG. 1 by pulling the upper, free ends of the handle members 13, 14 away from each other. When the tool 10 is covering the protruding portion of the nail, staple, tack, or other object, the handle members are preferably approximately perpendicular to the surface. By "covering the nail" is meant that the two jaw members are in place on either side of the nail shaft, staple, or other object. The tool 10 is placed over the projecting portion of the elongated object, with the first jaw member 17 on one side of the projecting portion of the object and the second jaw member 18 on the other side. Once the tool 10 is resting on the surface, ordinarily a wooden board, the upper, free end portions of the handle members 13, 14 are squeezed towards one another, which closes the jaw members over the object. This is accomplished with one hand.

As shown in a preferred embodiment in FIGS. 1–6, the second handle member 14 comprises a serrated first jaw member 17 along one end portion, and the floating head portion 15 comprises a corresponding serrated second jaw member 18 along one of its sides. The tool's jaw members 17, 18 are parallel to one another. Preferably, one or both, most preferably both, jaws are serrated. The serrated teeth allow a good grip on the shaft of the embedded object. As shown in FIGS. 1–4, the serrated gripping teeth, are most preferably oriented in an upward direction (i.e., leaning toward the main pivot pin), and oppose one another, in order to facilitate gripping of the object being extracted. The uppermost, or first, set of teeth in each jaw member preferably oppose each other, so that the tool 10 contacts the embedded object as close to the surface (substrate) as possible. Other gripping means could be employed in place of serrated teeth.

As illustrated by the figures, the floating head portion 15 has an upper edge 19 that is curved, so that the tool 10 can rock back on the curved edge 19 during extraction of the nail, tack, staple, or the like. By "floating" head portion is meant that this portion of the tool is movable and is not connected to the rest of the tool except by pivot pins. The curved edge 19 on the floating head portion creates a lifting force, with minimum resistance to the user. The curved edge 19 of the floating head portion is preferably flattened, so that the flat edge is in contact with the surface when the closed tool 10 rocks back.

Figure 5:
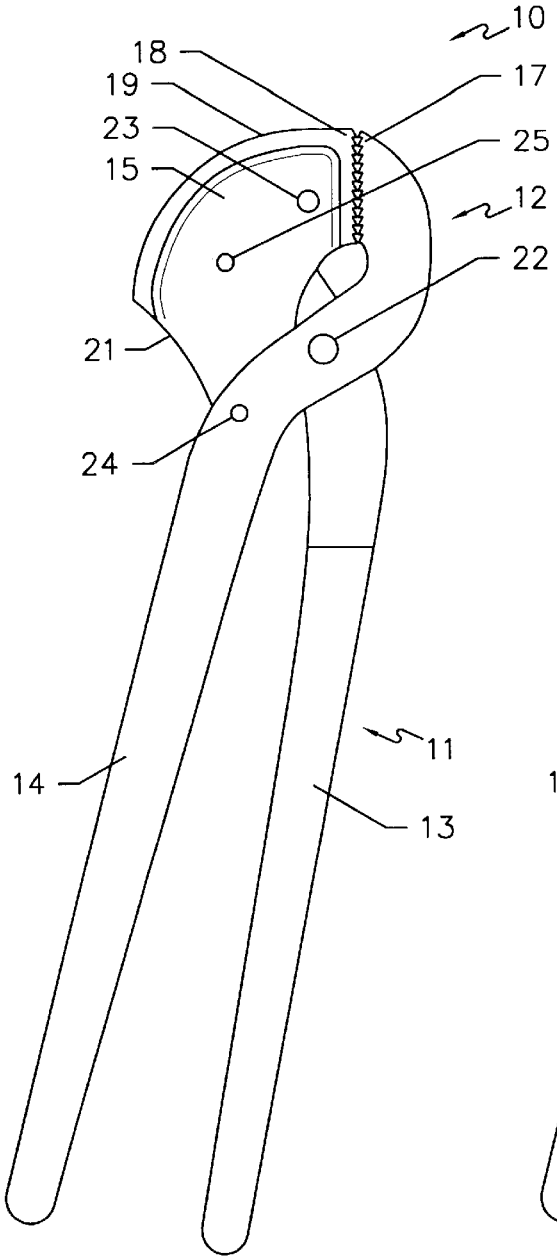
FIG. 5 is a rear perspective view of an extracting tool according to the present invention, shown in a closed position.
Figure 6:
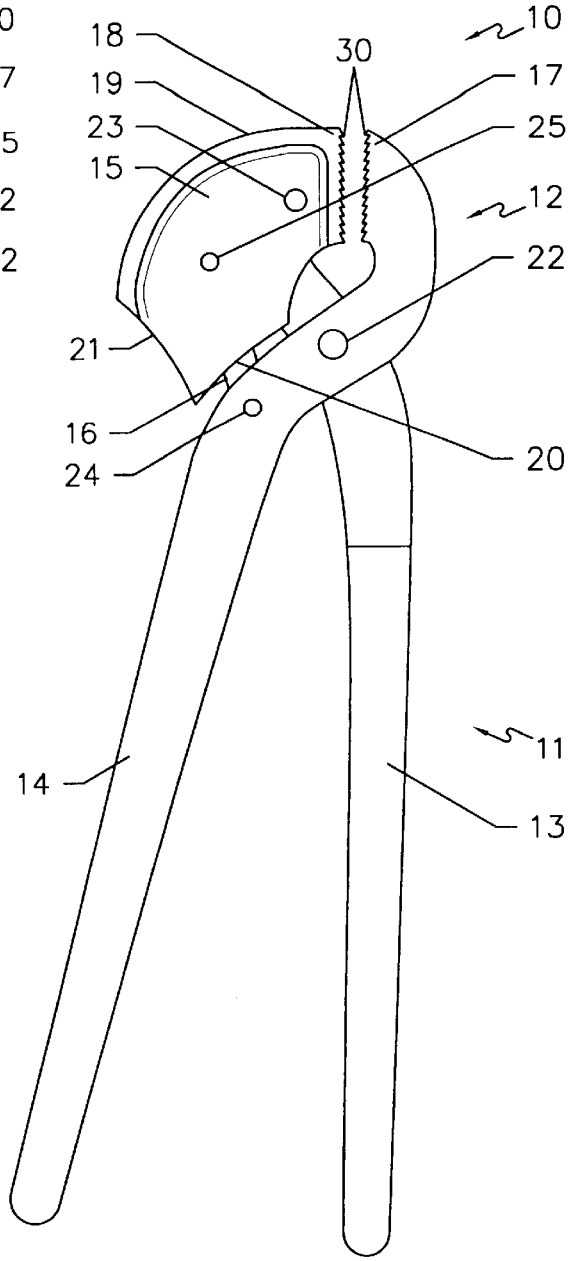
FIG. 6 is a rear perspective view of the extracting tool of FIG. 5, shown in an open position.

The width of the curved edge 19 can vary, although it is preferably between about ¾ and 1 ¼ centimeters, most preferably approximately ⅜ inch, in width. This width helps to prevent damage to the surface (ordinarily wood) during extraction of the nail. A thin layer of rubber or other cushioning material, or a protective coating, can be applied along the curved edge 19 to further cushion the curved edge. The remainder of the floating head portion may be at a slightly lower level than the curved edge 19 and the jaw member 18, as shown in FIGS. 5 and 6. As a result, the ends of the second and third pivot pins 23, 25, which project through the floating head portion 15, are not as likely to scratch the user. This allows the tool 10 to have a flatter front and rear appearance, and facilitates shipping of these tools.

Figure 7:
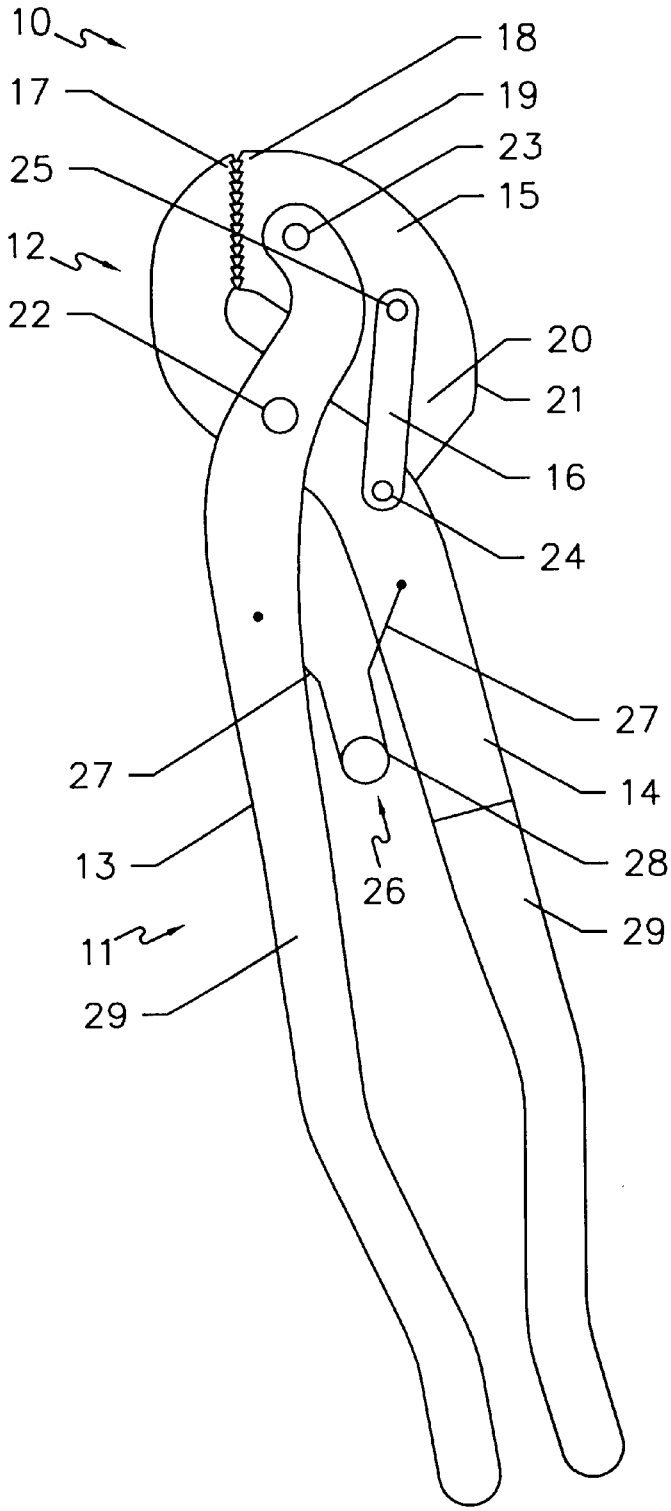
FIG. 7 is a front elevational view of an alternate embodiment of an extracting tool according to the present invention.

Referring to FIGS. 1–6, the third, lower side 20 of the floating head portion 15 is preferably slightly curved so that it fits against the curve in the second handle member 14 when the tool is in a closed position. However, the floating head portion can have various shapes and need not fit against the second handle member, as shown in FIG. 7. The shape of the fourth side 21 of the floating head portion 15, which is approximately opposite to the first side, basically does not affect the function of the floating head portion. In the alternate embodiment shown in FIG. 7, the third side 20 of the floating head portion does not fit against the second handle member, and the fourth side 21 is more rounded.

As shown in FIGS. 1–6, each tool 10 comprises four pivot points in two sets. The first set of pivot pins are inserted along an upper end portion of the first handle member 13. A main pivot pin 22 pivotally connects the first handle member 13 to the second handle member 14 at the base of the head section 12. A second pivot pin 23 pivotally connects the end of the first handle member 13 and a forward section of the floating head portion 15 next to the second jaw member 18. At the main pivot pin 22, the curved first handle member 13 crosses perpendicularly over the curved second handle member 14, generally forming an X-shape. The second set of pivot pins is inserted at opposite ends of the lever bar 16. A third pivot pin 24 connects the lower end of the lever bar 16 to the second handle member 14, and a fourth pivot pin 25 pivotally connects an upper end of the lever bar 16 to a rear section of the floating head portion 15. Each pivot pin can alternatively be a rivet or screw at a similar pivot point. The lever bar 16 maintains the parallel relationship between the jaw members 17, 18, and links the handle members to each other so that the second handle member contributes to the force required to extract the nail. The lever bar 16 is preferably on the front of the tool, as shown in the figures, but it could alternatively be located at the rear of the tool. wherein the first handle member has a curved end portion, the end of which is pivotally attached to the floating head portion.

Thus, 1) the main pivot pin 22 passes through corresponding holes in the first handle member 13 and the second handle member 14, 2) the second pivot pin 23 passes through corresponding holes in the end of the first handle member 13 and a forward section of the floating head portion 15, 3) the third pivot pin 24 connects through corresponding holes in the second handle member 14 and a lower end of the lever bar 16, and 4) the fourth pivot pin 25 passes through corresponding holes in an upper end of the lever bar 16 and a rear section of the floating head portion 15. The distance between the main pivot pin 22 and the second pivot pin 23, and between the third pivot pin 24 and the fourth pivot pin 25, are substantially equal to one another. The distance between the main pivot pin 22 and the third pivot pin 24, and between the second and fourth pivot pins 23, 25, are substantially equal to one another. A parallelogram is thus formed. The parallelogram shape shifts as the tool 10 is brought from an open position to a closed position and back again. Preferably, the main pivot pin 22 is a screw, and the second, third, and fourth pivot pins 23–25 are rivets. The jaw members maintain a parallel relationship to one another in both the open and closed positions.

Figure 2A:
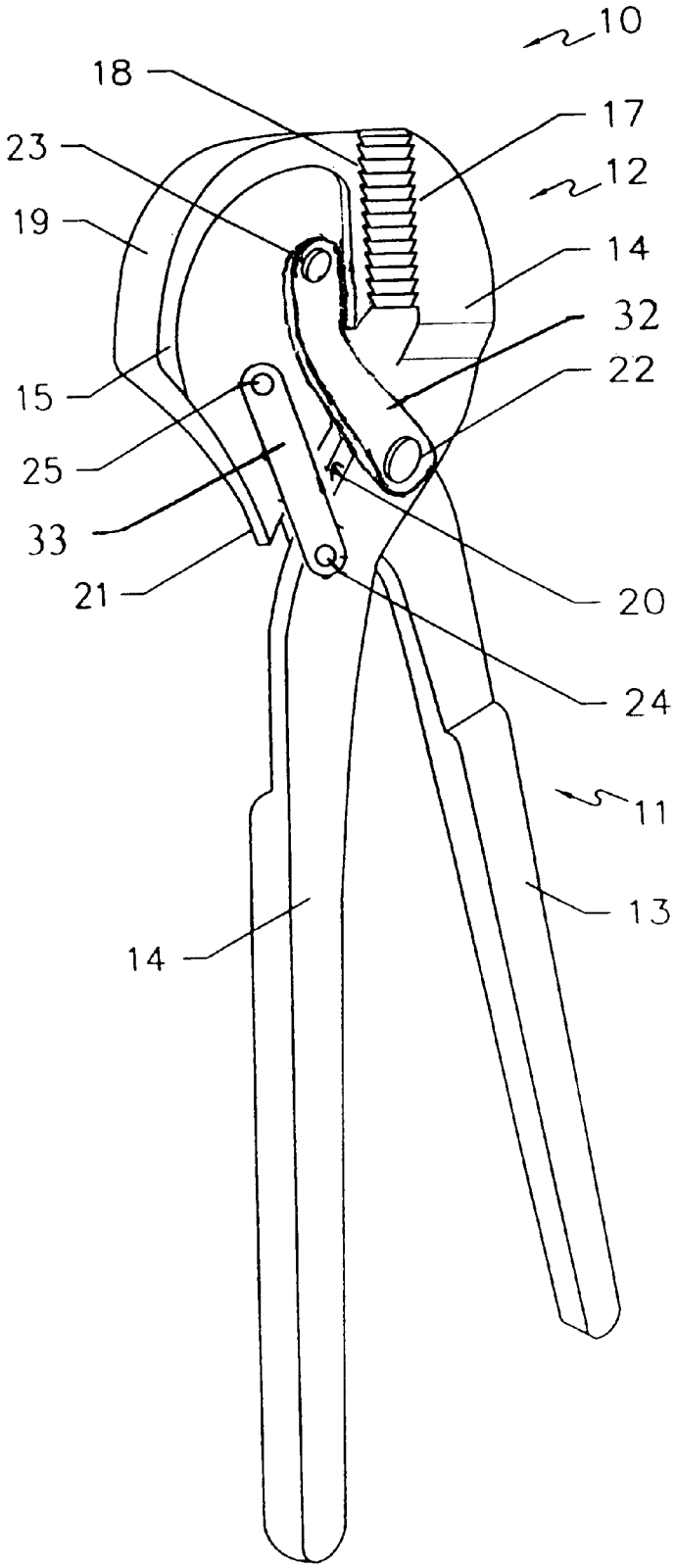
FIG. 2*a* is a rear elevational view of an alternate embodiment of an extracting tool according to the present invention.

In the alternate embodiment shown in FIG. 2*a*, a pivotable second lever bar 32 connects the main pivot pin 22 and the second pivot pin 23, and/or a pivotable third lever bar 33 connects the third pivot pin 24 and the fourth pivot pin 25 for added strength.

The tool of the present invention employs a compound lever action. The lever bar 16 is pivoting further out on the floating head portion 15 and is anchored to the second handle member 14, which has the opposite jaw member 17. Without meaning to be bound by theory, it is believed that two important things happen because of this compound lever action: a) the jaw members 17, 18 stay in a parallel relationship, which maintains as many teeth as possible in contact with the object for a slip-free grip; and b) the curved edge 19 is attached to the opposing jaw member by the lever bar 16. Once the rolling or lifting of the nail, staple, or other elongated object begins, the resistance force is passed to the jaw member opposite to the curved edge, which causes a self-actuating grip. Net: once the extraction is initiated, the handle members no longer need to be squeezed. At that point, only a prying action is required to complete the extraction.

This tool 10 is for removing damaged or intact nails or tacks, staples inserted with a pneumatic gun, or the like, by gripping the exposed part of the nail or staple once the board is removed from the wall. The tool of the present invention can grasp and remove slender or thick nails, tacks or staples with smooth or rough finishes. It can be used on nails manufactured without heads, and nails with heads that are broken or sheared off. This tool 10 is capable of pulling long or short, intact or broken-off nails, staples, or tacks, regardless of whether they were driven into the surface by a hammer or by pneumatic means. This tool 10 works particularly well on wiring staples, fencing staples, roofing tacks, and upholstery tacks. The tool can also be used for other common tasks, like holding a bolt, or straightening a metal wire.

This tool is preferably for use on finishing nails of any length or width, bent or straight, especially pneumatic finishing nails. Relatively new pneumatic finishing nails are particularly difficult to remove from surfaces because they have a very smooth finish and are so slender that they cannot easily be backed out without bending them. Efforts to pull them out of wooden surfaces using conventional tools often results in splintering of the surface or in the nails snapping off. The nail removal tool of the present invention grabs these pneumatic finishing nails and ordinarily pulls them cleanly through and out of the surface.

The nails, etc. to be removed may be embedded in wooden baseboards, moldings, shelving, paneling, hardwood floors, etc. The tool of the present invention is particularly useful for remodeling projects. Workmen who will be pulling apart wooden elements of a residence or business and then replacing them may also find this tool helpful. For example, exterminators and burglar alarm installers often must pull up baseboards, etc. to do their work. They can use this tool for removing nails prior to reattaching the baseboards and other surfaces. This tool is useful wherever the removal and spent nails from wooden or wood-like surfaces is particularly important. It is particularly useful for remodeling projects in historic homes, where preservation of existing crown moldings, baseboards, etc. is of paramount importance.

Figure 8:
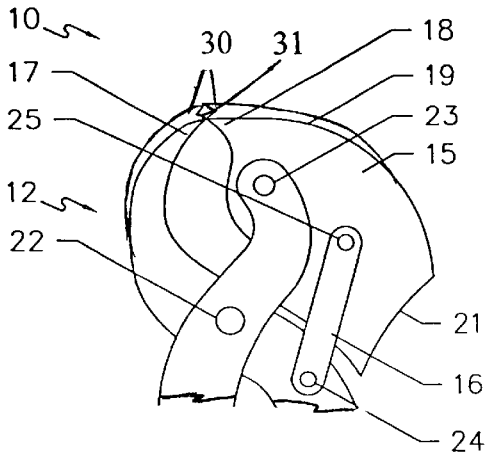
FIG. 8 is a front perspective view of an alternate embodiment of a head portion of an extracting tool according to the present invention.

Referring to FIGS. 7 and 8, alternate embodiments of the extracting tool 10 include a spring device 26 between the first and second handle members 13, 14 under the head section 12. With the spring device 26 between the handle members, it is not necessary to pull part the handle members before beginning the extraction. This embodiment may be more comfortable for a user with small hands to use. The spring device 26 allows the handle members to spring back into the open position once the handle members are released.

In the embodiment illustrated in FIG. 7, the spring device 26 comprises two bent arms 27, with a spring 28 between the two arms. An upper end of each arm 27 attaches through a hole in one of the handle members 13, 14. The lower ends of the two arms 27 continue into the spring 28 formation. One of the arms 27 is positioned against the first handle member 13, and the other is positioned against the second handle member 14. The spring device may alternately include an expansion spring wrapped around two arms projecting from the inside of each handle member. The upper, free end portions of the handle members 13, 14 may have textured rubber-like covers or grips 29 for comfort.

Figure 9:
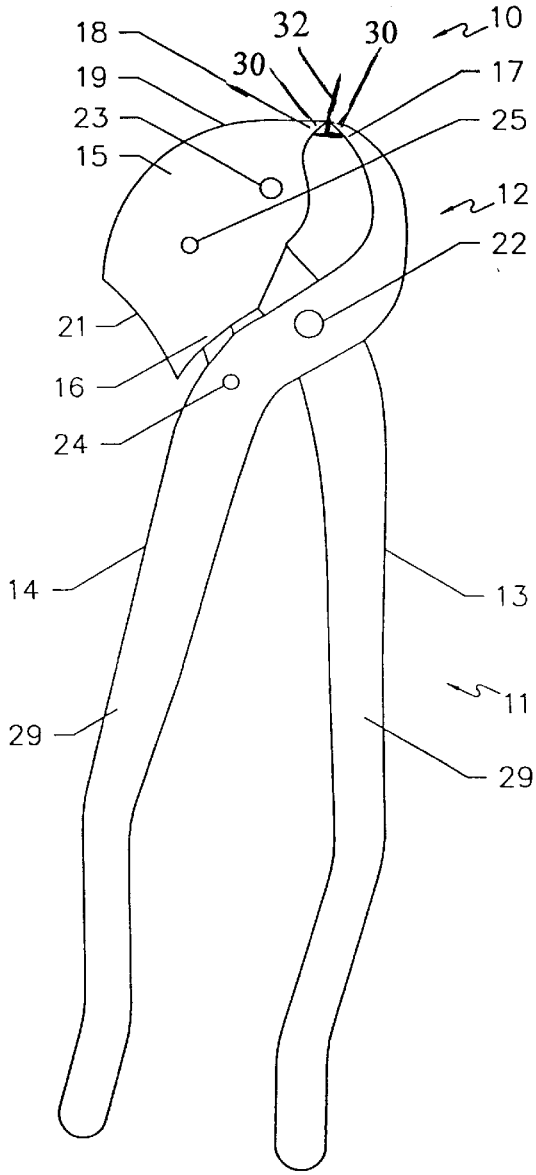
FIG. 9 is a rear elevational view of the extracting tool according to FIG. 8. shown holding a tack.

In the alternate embodiment illustrated in FIGS. 8 and 9, only an elongated top row of opposing teeth remains. This first set of teeth 30 on the opposite jaw members 17, 18 oppose one another. This allows the tool a grasp of small, fine objects. The jaw members curve inwardly below the first set of teeth, and do not include additional teeth. In this preferred embodiment, the first set of teeth 30 on each jaw member are similarly forked, so they form a diamond shaped orifice 31 when the tool 10 is in a closed position. The orifice 31 is smaller than the head of a conventional nail or tack; thus, the orifice 31, as well as the inward curve of the jaw members, allow the head of a tack 32 or nail to be held inside the tool 10, as shown in FIG. 9, without slipping through the tool 10. This provides better leverage when the nail or tack is being extracted. Since the sharp ends of the opposing teeth 30 contact one another, the orifice 31 minimizes the chances that the opposing teeth 30 will shear off the nail or tack. This embodiment works particularly well for upholstery tacks 32. If the tack 32 has a head with a diameter that fits between the inward curves of the jaw members, as shown in FIG. 9, a lifting motion is also imparted when the tool 10 grips the tack 32. The pointed, opposing first teeth 30 and the inward curve of the jaw members are also helpful in extracting pneumatically driven, industrial staples, which are often embedded deeply in a surface. Generally, the pointed opposing teeth 30 fit under each end of the crown of the implanted staple. This embodiment is particularly useful where there is a single point of contact with the embedded object.

As shown in FIG. 9, the handle members 13, 14 are each bowed slightly outwardly in the center, and preferably also each crooked at the base, for a better grip by the user.

In a preferred embodiment: a) the tool 10 is between about ten and 12 inches in length and about two and three inches wide; b) the jaw members 17, 18 are between about ½ inch and 1 ½ inches in length, and about ¼ and ½ inch in width; c) the curved edge 19 is between about two and three inches in length and about the same width as the jaw members; d) the lever bar 17 is between about one and two inches in length; and e) the floating head portion 15 is between about one and three inches in length and width. The long handle members 13, 14 are useful for gaining leverage during the extraction process.

Figure 10:
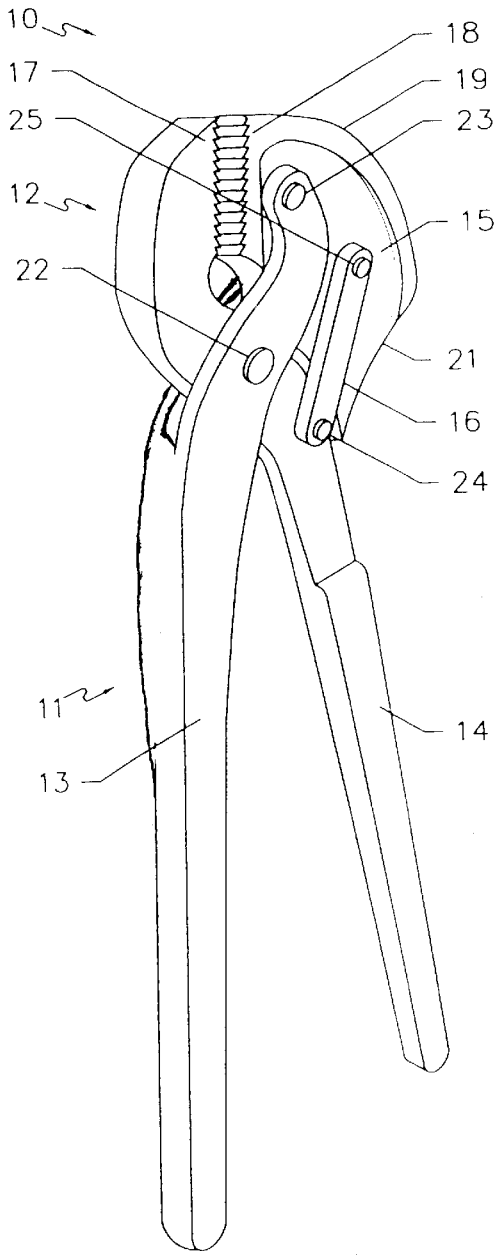
FIG. 10 is a front perspective view of an alternate embodiment of an extracting tool according to the present invention.
Figure 11:
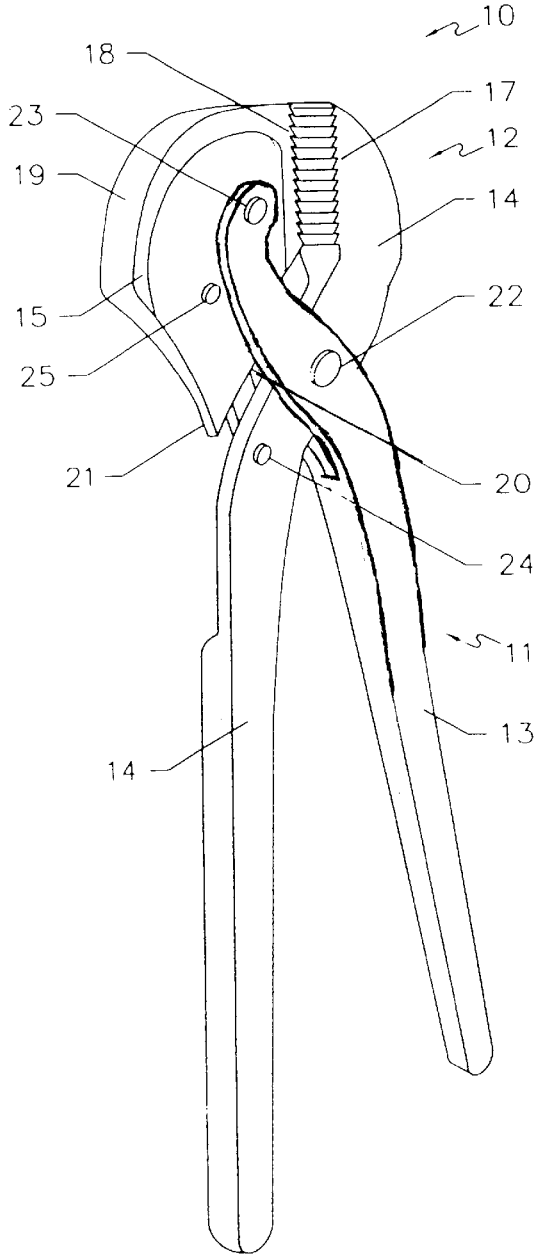
FIG. 11 is a rear perspective view of an extracting tool according to FIG. 10.

In the alternate embodiment shown in FIGS. 10 and 11, an upper portion of the first handle member 13 splits just before the main pivot pin 22. These split first handle member portions straddle the second handle member 14 and the floating head portion 15, for added tool strength and case of manufacture. The split first handle member portions end at, and arc both pinned by, the second pivot pin 23. The tool's mechanics are otherwise as described above.

This invention is a versatile, inexpensive, hand operated tool for removing nails, tacks, staples, or other elongated objects from surfaces, such as moldings, baseboards, and shelves, without unduly damaging the surface. With the present device, the worker's initial attempts at removal of nails, tacks, and staples are successful a high percentage of the time. It is believed that this is more true of the present tool than of other currently available devices.

Also included within the present invention is a method for extracting an elongated object through a body made of wood or a wood substitute and having a surface. The method includes the steps of:

a) engaging a portion of the object by a tool;

b) operating the tool such that the tool grips the object and exerts twisting and pulling forces on the object in a direction at an acute angle to the body surface;

c) rocking the tool back on a curved, flattened edge of the tool in a direction away from the wooden surface, so as to disengage the object from the surface; and d) disengaging the object from the tool.

From the foregoing it can be realized that the described tool of the present invention may be easily and conveniently utilized for extracting elongated objects from surfaces in which they are embedded. While preferred embodiments of the invention have been described using specific terms, this description is for illustrative purposes only. It will be apparent to those of ordinary skill in the art that various modifications may be made without departing from the spirit or scope of the invention, and that such modifications are intended to be within the scope of the present invention.

Brief List of Reference Numbers Used in the Drawing

10 extraction tool
11 handle section
12 head section
13 first handle member
14 second handle member
15 floating head portion
16 lever bar
17 first jaw member
18 second jaw member
19 curved edge of floating head portion
20 lower side of floating head portion
21 fourth side of floating head portion
22 main pivot pin
23 second pivot pin
24 third pivot pin
25 fourth pivot pin
26 spring device
27 arms of spring device
28 spring
29 handle grip
30 first set of teeth
31 orifice
32 tack

What is claimed is:

1. A hand operated tool for extracting an elongated object that is embedded in the surface of a body, the tool comprising:

a) an elongated, movable first handle member;

b) a corresponding second handle member pivotally attached to the first handle member, the second handle member comprising a first jaw member;

c) a floating head portion pivotally attached to the first handle member, the floating head portion comprising a second jaw member and an adjacent curved edge; and d) a lever bar pivotally connected at one end portion of the lever bar to the second handle member and at an opposite end portion of the lever bar to the floating head portion; and wherein the extracting tool generally has an open position for placing the jaw members on opposite sides of the elongated object, and a closed position for grasping and pulling the elongated object; and wherein the second jaw member is engaged against the first jaw member when the tool is in the closed position, and disengaged from the first jaw member when the tool is in the open position.

2. A tool according to claim 1, wherein the first and second jaw members each comprise serrated teeth.

3. A tool according to claim 2, wherein the curved edge of the floating head portion Is flattened and oriented perpendicular to the second jaw member.

4. A tool according to claim 3, wherein each tooth opposes a corresponding tooth on the opposite jaw member.

5. A tool according to claim 1, further comprising a main pivot pin which passes through corresponding holes in the first handle member and the second handle member.

6. A tool for extracting an elongated object that is embedded in the surface of a body, the tool comprising:

a) an elongated, movable first handle member;

b) a corresponding second handle member pivotally attached to the first handle member, the second handle member comprising a first jaw member;

c) a floating head portion pivotally attached to the first handle member, the floating head portion comprising a second jaw member and an adjacent curved edge; and d) a lever bar pivotally connected at one end portion of the lever bar to the second handle member and at an opposite end portion of the lever bar to the floating head portion;

(e) a main pivot pin, which passes through corresponding holes in the first handle member and the second handle member; and (f) a second pivot pin, which passes through corresponding holes in an end portion of the first handle member and a forward section of the floating head portion;

wherein the extracting tool generally has an open position for placing the jaw members on opposite sides of the elongated object, and a closed position for grasping and pulling the elongated object; and wherein the second jaw member is engaged against the first jaw member when the tool is in the closed position, and disengaged from the first jaw member when the tool is in the open position.

7. A tool according to claim 6, further comprising a third pivot pin which connects through corresponding holes in the second handle member and a lower end of the lever bar.

8. A tool according to claim 7, further comprising a fourth pivot pin which passes through corresponding holes in an upper end of the lever bar and a rear section of the floating head portion.

9. A tool according to claim 8, wherein the distance between the main pivot pin and the second pivot pin, and between the third pivot pin and the fourth pivot pin, are substantially equal to one another.

10. A tool according to claim 9, wherein the distance between the main pivot pin and to third pivot pin, and between the second and fourth pivot pins, are substantially equal to one another, thus forming a parallelogram.

11. A tool according to claim 6, wherein the first handle member has a curved end portion, the end of which is pivotally attached to the floating head portion.

12. A tool according to claim 10, wherein the pivot pins are pivotable rivets.

13. A tool according to claim 10, wherein the jaw members maintain a parallel relationship to one another in both the open and closed positions.

14. A tool according to claim 13, further comprising a spring device between the two opposing handle members under the head section.

15. A tool according to claim 13, wherein the handle members are bowed outwardly in the center.

16. A tool according to claim 1, wherein the opposite jaw members comprise a first set of teeth that oppose one another.

17. A tool according to claim 16, wherein the jaw members curve inwardly below the first set of teeth, and do not comprise additional teeth.

18. A tool according to claim 17, wherein the first set of teeth on each jaw member are similarly forked, and form a diamond-shaped orifice when the tool is in a closed position.

* * * * *